US007604135B2

(12) United States Patent
Paschke

(10) Patent No.: US 7,604,135 B2
(45) **Date of Patent: *Oct. 20, 2009**

(54) TENSIONING SYSTEM FOR A MOBILE TELESCOPIC CRANE

(75) Inventor: Franz Paschke, Sande (DE)

(73) Assignee: Grove U.S. LLC, Shady Grove, PA (US)

( * ) Notice: Subject to any disclaimer, the term of this patent is extended or adjusted under 35 U.S.C. 154(b) by 43 days.

This patent is subject to a terminal disclaimer.

(21) Appl. No.: 11/867,536

(22) Filed: Oct. 4, 2007

(65) Prior Publication Data

US 2008/0023432 A1 Jan. 31, 2008

Related U.S. Application Data

(62) Division of application No. 10/811,809, filed on Mar. 30, 2004, now Pat. No. 7,293,669.

(30) Foreign Application Priority Data

Apr. 8, 2003 (DE) ..... 103 15 989

(51) Int. Cl.
*B66C 23/687* (2006.01)

(52) U.S. Cl. ..... 212/264; 212/299

(58) Field of Classification Search ..... 212/298–230, 212/264

See application file for complete search history.

(56) References Cited

U.S. PATENT DOCUMENTS

| | | | | |
|---|---|---|---|---|
| 4,360,111 | A | 11/1982 | Weiskopf | |
| 6,550,624 | B1 | 4/2003 | Irsh et al. | |
| 7,293,669 | B2 * | 11/2007 | Paschke | 212/264 |
| 2002/0070187 | A1 | 6/2002 | Willim | |

FOREIGN PATENT DOCUMENTS

| | | | |
|---|---|---|---|
| DE | 1751383 | | 8/1957 |
| DE | 3113763 | C2 | 10/1982 |
| DE | 29720 972 | U1 | 5/1999 |
| DE | 19802187 | C2 | 7/1999 |
| DE | 20107984 | U1 | 1/2002 |
| EP | 1215161 | A1 | 10/2001 |
| GB | 2096097 | A | 10/1982 |
| WO | WO 99/36343 | A1 | 7/1999 |
| WO | WO 00/34173 | A1 | 6/2000 |

* cited by examiner

*Primary Examiner*—Thomas J. Brahan
(74) *Attorney, Agent, or Firm*—Birch, Stewart, Kolasch & Birch LLP

(57) ABSTRACT

A tensioning system for a mobile telescopic crane having a telescopic mast includes at least one tensioning cable for bracing the telescopic mast and at least one tensioning winch mounted on the crane superstructure for tensioning the cable. The tension in the cable creates a pressure bias within the mast. The winch is movable with respect to said superstructure of the crane and movement of the winch relative to the superstructure also imposes tension on the tensioning cable.

16 Claims, 8 Drawing Sheets

TENSIONING SYSTEM FOR A MOBILE TELESCOPIC CRANE

This application is a Divisional of application Ser. No. 10/811,809, filed on Mar. 30, 2004 now U.S. Pat. No. 7,293,669, the entire contents of which are hereby incorporated by reference and for which priority is claimed under 35 U.S.C. §120.

BACKGROUND OF THE INVENTION

The present invention relates to a tensioning system for a mobile telescopic crane, in which the telescopic mast is outwardly braced via a tensioning means. In particular, the present invention relates generally to optimally integrating a tensioning system and the components connected to it with a jib design on the superstructure of a mobile telescopic crane.

The aim of any jib design is to keep the ratio of its tare weight to its working load small. The overall system must also exhibit sufficient rigidity to meet the performance capability demanded by the standards.

Jib construction mainly employs fine-grained constructional steel with increasingly higher strengths up to a yield point of 1100 N/mm$^2$. The modulus of elasticity and the available design space remain almost unchanged, hence the deformations border on the limits of performance capability. Deformations such as in a fishing rod are, however, not desirable in lifting platforms and in the field of cranes.

The hollow sections used for a jib are mainly subjected to bending stresses. In terms of tension, only the peripheral fibres are utilised, the material being inactive in the centre. The stability of other panel-like areas is endangered; using superior material has no effect.

It is important to develop light-gauge designs which optimally utilise the material strengths; this applies in particular to vehicle cranes. Filigrees and meticulous designs with little deformation are efficient and save weight. The bearing loads in the range of strength and in the range of steadiness of the existing crane classes would have to be significantly increased still.

A jib section for a braced system with high-tensile materials is described in DE 201 20 121 U1. This teaches how an increase in bearing load can be achieved by shell-segment designs curved outwards. Bracing designs are known from DE 200 02 179 U1 and DE 100 22 658 A1 which are limited to an overhead line of the main jib, arranged in the level luffing plane or inclined with respect to the level luffing plane, wherein a rigid or linearly adjustable mast is fastened to the jib base portion.

It is the object of the present invention to provide a tensioning system for a mobile crane telescopic jib, said system improving the bearing capacity of the telescopic mast, wherein mast deformations in particular are to be reduced.

BRIEF SUMMARY OF THE INVENTION

This object is solved, in accordance with one aspect of the invention, by a tensioning system in which the tensioning means is guided along or over the telescopic mast and fastened to the telescopic mast in such a way that a pressure bias of the mast is created in the area of the tensioning means guide.

The advantage resulting from the invention is based in particular on the fact of omitting the bending beam such that the material properties of high-tensile mast materials having very high yield points can be used. Masts which are pressure-biased by tensioning means can directly absorb the pressure bias in the material and, when loaded, can use the favourable resultant tensile force. In accordance with the invention, when a system is biased in this way, the effect then arises that the bending rigidity of the jib is combined with a defined bracing force and the jib section together with the bracing and biasing forms a unit with a favourable bearing load, in all states of the crane. This creates the possibility of using masts made of high-tensile material with a low tare weight, wherein as opposed to the situation in accordance with the prior art, the high strength of the materials can also be utilised. Maximum admissible stresses in the peripheral fibres, both in the jib and in the turntable support for the counterweight and caused by bending, are compensated for by biasing and bracing.

In a preferred embodiment of the invention, the tensioning means is guided on both sides of the bracing and biasing mast portion, so as to be able to effectively apply the pressure bias. It is then possible to guide the tensioning means from an outer bearing point to a joining point in the upper mast area and then along the jib to an inner or outer bearing point in the lower portion of the mast. The tensioning means can be turned and deflected at the upper joining point by means of a roller.

In one embodiment of the tensioning means in accordance with the invention, in which the upper run of the mast is braced and biased, the tensioning means is guided to the upper portion of the mast by a tensile unit or winch provided on the crane superstructure, via at least one pylon and/or at least one bracing support. The pylon or pylons can be fastened, swivelling, in the area of the crane superstructure and in particular can be arranged protruding obliquely from the luffing plane, in order to also be able to absorb forces arising obliquely with respect to the luffing plane.

Advantageously, when the lower run of the mast is braced and biased, the tensioning means is guided to the upper portion of the mast by a tensile unit or winch provided on the crane superstructure.

Two tensioning means can be provided for the upper run of the mast, and additionally or alternatively for the lower run of the mast, one on each side respectively (at a distance from the luffing plane).

If, as mentioned above, an inner or outer bearing point is provided is the upper portion of the mast for the tensioning means, it is advantageous to arrange said bearing point on the lowermost extending telescopic portion. This ensures that substantially the entire length of the jib can be biased.

If an auxiliary crane tip, for example a fixed tip or a level luffing tip, is provided, it is advantageous in accordance with the invention to also guide the tensioning means, at least in sections, along or over the tip.

In accordance with another aspect of the present invention, a tensioning system is provided, in which the tensile units or winches on the crane superstructure are at a distance from the luffing plane of the telescopic mast of the crane, such that the tensioning means can absorb a substantial proportion of the loads having components perpendicular to the level luffing plane. This ensures that lateral loads, for example loads from wind pressure, which act in any direction transverse to the luffing plane can also be absorbed and compensated for within the tensioning system in accordance with the invention. In such designs, it is favourable to arrange the tensioning means tensile units or winches for bracing the upper run of the mast behind the mast joint of the crane superstructure, since they can then simultaneously act as a counterweight.

Another aspect of the present invention is realised by arranging the tensioning means tensile units or winches on the crane superstructure, in a tensioning system for a mobile telescopic crane comprising tensioning means winches and tensioning means for bracing the telescopic mast, such that they can shift. In principle, horizontal and vertical shifting is conceivable, applications comprising vertical shifting in particular being permitted, such as for example—in accordance with a preferred embodiment—assigning the tensioning means tensile units or winches to counterweights of the crane, wherein the tensile units or winches can be connected to individual or all corresponding counterweights. Using such a design, it is possible to apply the bias in the tensioning means using the weight force of the counterweights and so save on those units which otherwise provide such tensile forces, for example using motors.

In accordance with another embodiment variant, it is also proposed to attach the tensioning means tensile units or winches to the crane superstructure via damping units, in order to avoid dynamic impairment.

Overall, the present invention can also be defined as one in which the major components of the superstructure, for example the jib, bracing, pylons, biasing, expelling unit, turntable, counterweight and tensioning means tensile units, are designed and combined in such a way that, depending on the operational state, the individual sub-assemblies automatically perform a number of functions and mutually assist each other in a way which enables a lighter and more stable bearing design overall. The features cited in this description can be employed in this way, individually or in any combination. In particular the reduction in weight and the re-arrangement of the major components of the superstructure made possible within the framework of the invention, as well as combining them operationally, provide advantages which it has not so far been possible to achieve in the prior art.

With straight or oblique bracings comprising bracing gantries on the mast, for example, it was not possible to carry the rear and the front bracing and the cable winch while travelling on roads, because this exceeded the vehicle height and/or total admissible weight. The high assembly costs were a further disadvantage. An additional assembly crane for placing the bracing gantry was necessary and assembly work had to be performed at a height of three or four meters, at points relatively far apart, which significantly increased the risk of accidents. Cranes braced in this way contained additional weld-on structures on the jib base portion, in order to connect the bracing gantry (pylon), the erecting cylinder and the rear bracing. All these auxiliary weights increased the axle loads while travelling on roads. During operation, all the weights with respect to the bracing were situated in front of the turning centre. The weights of the bracing unit negatively effect all the bearing loads limited by the ball turning connection, the level luffing cylinder, the support presses, the chassis and the steadiness. In order to equalise the auxiliary moment from the bracing weights, a larger counterweight was necessary, resulting in extra costs for the counterweight and the turntable and chassis design, as well as additional transport costs.

The above problems can be solved by the bias in accordance with the invention and the associated savings in weight made possible by it, by arranging the tensioning means tensile units in accordance with the invention and integrating them with other units situated on the superstructure, and by redesigning the superstructure as enabled in accordance with the invention.

BRIEF DESCRIPTION OF THE DRAWINGS

In the following, the invention is explained in more detail by way of example embodiments and by referring to the enclosed drawings, which show.

DESCRIPTION OF THE INVENTION

Figure 1A:
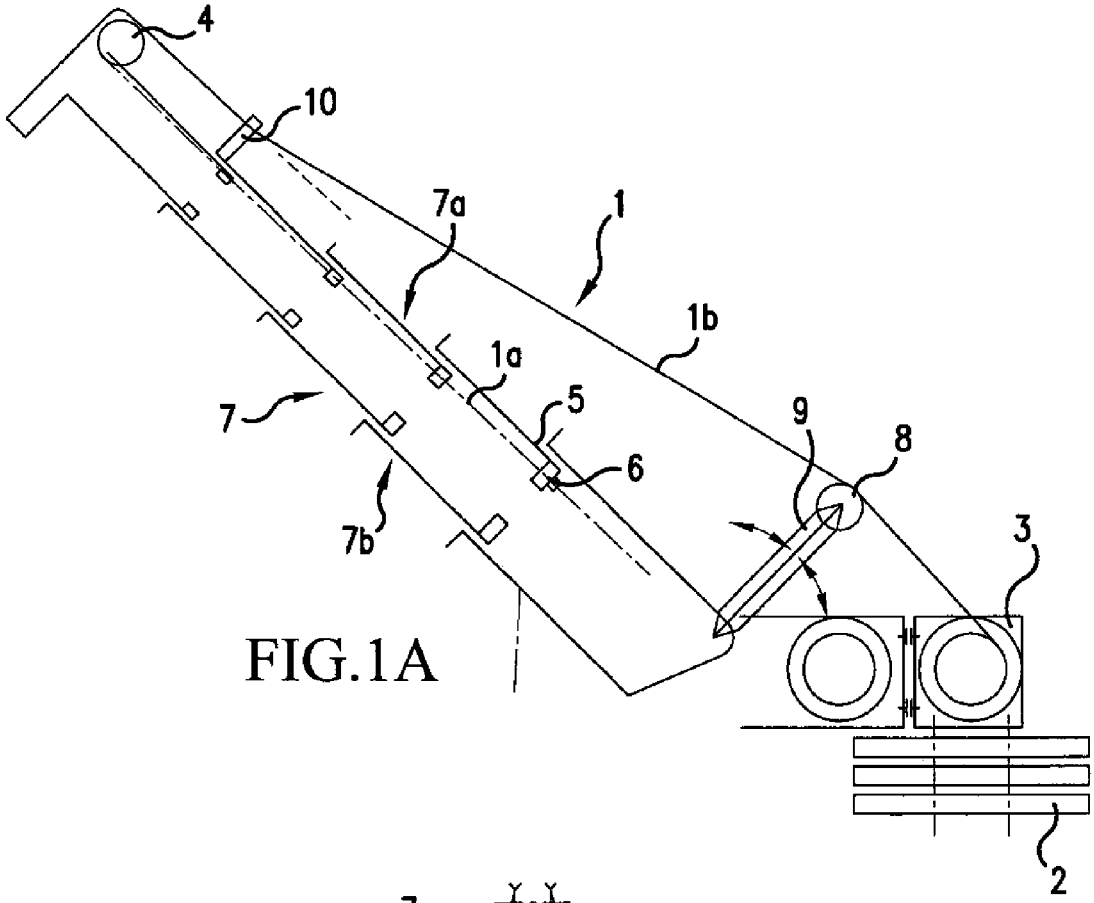
FIGS. 1A and 1B a lateral and a rear view of a telescopic mast, biased on the upper run in accordance with the invention.
Figure 1B:
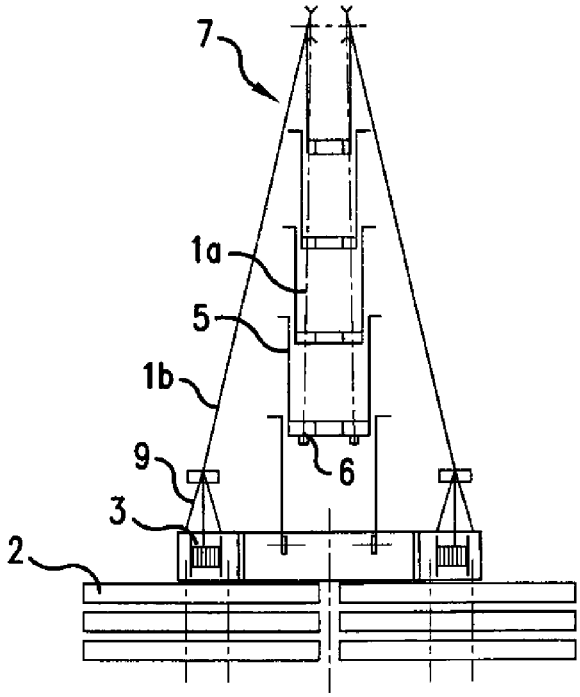

In the figures, identical reference numerals indicate identical or functionally identical structural unit. FIGS. 1A and 1B show a lateral and a rear view of a telescopic mast for a mobile crane, tensioned on the upper run in accordance with the invention. The telescopic mast 7 and its bracing and biasing system comprising cable winches 3 and counterweights 2 is shown. The mast 7 consists of a number of telescopic portions, of which only the first extending telescopic portion is separately indicated by the reference numeral 5. The lower run of the mast bears the reference numeral 7*b* and the upper run, which in this case is biased, has the reference numeral 7*a*.

The telescopic mast is tensioned towards both sides of the luffing plane, the components in FIG. 1B are only provided with reference numerals on the left-hand side. The tensioning system functions as follows:

Starting from the cable winch 3, the tensioning cable 1 runs as its outer portion 1*b* firstly over a roller 8 on the pylon 9 which is fastened, swivelling, to the crane superstructure as shown by the arrows. From the roller 8, the cable 1*b* passes through the gantry 10 and at the roller 4 at the tip of the mast is turned and deflected into the telescopic jib, where it runs as its inner portion la along the inner side of the jib to the lower portion of the first telescopic portion 5, where it is secured on the fastening 6. The bias of the cable via the counterweights 2 is explained in more detail by way of FIG. 3. As follows from FIG. 1B, the winches 3 are situated laterally left and right away from the luffing plane and so provide the possibility of also supporting lateral forces. The mast 7 and the tensile cable 1 form one unit in all bearing states and while travelling on roads.

Figure 2A:
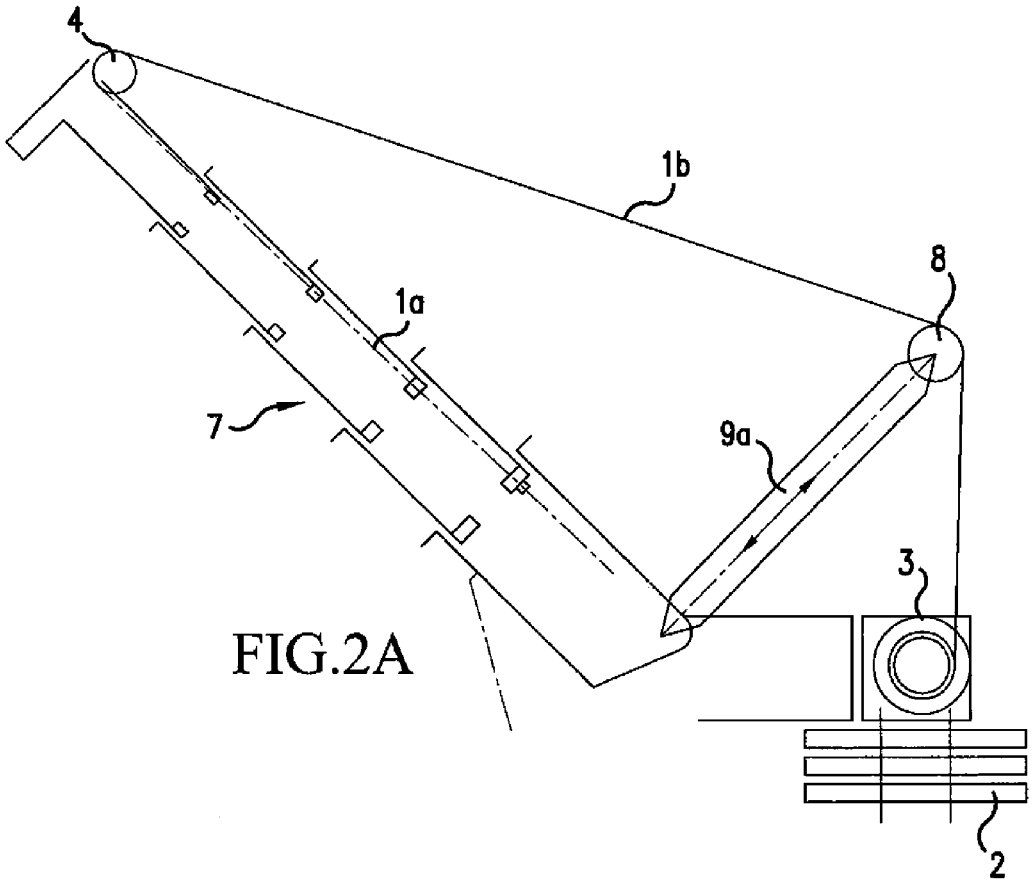
FIGS. 2A and 2B a lateral and a rear view of a telescopic mast, biased obliquely on the upper run in accordance with the invention.
Figure 2B:
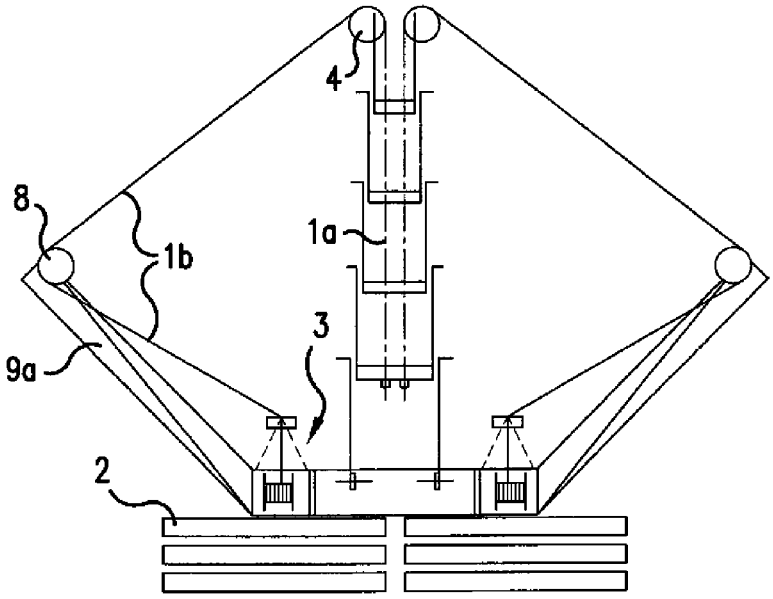

The telescopic mast is pressure-biased or compressed axially in its upper cross-sectional part 7*a* due to the effect of the force in the cable sections 1*a* and 1*b*. The upper run 7*a*, consisting of high-tensile steel, can directly absorb this pressure bias. If the telescopic mast is then loaded with weight, the resultant tensile forces in the upper cross-section act against the pressure forces from the bias. The bias or compression is relieved at these points, such that large, undesirable deformations can be avoided. The bending beam is omitted. FIGS. 2A and 2B show the same views as in FIGS. 1A and 1B, but with the difference that in this case a design has been chosen which ensures an increased lateral stability of the telescopic mast. To this end, longer, additionally coupled pylons 9*a* are provided which protrude outwards, i.e. laterally away from the luffing plane, and upwards. These pylons 9*a* can be linearly adjustable and they adjust the distance between the tensile cables and the main axes of the jib, so as to make it possible to adapt the direction of the effect of the bracing. A higher transverse stabilisation is provided, in addition to the longitudinal bracing provided, and the pressure bias acts in the same way as explained with respect to FIGS. 1A and 1B.

Figure 3:
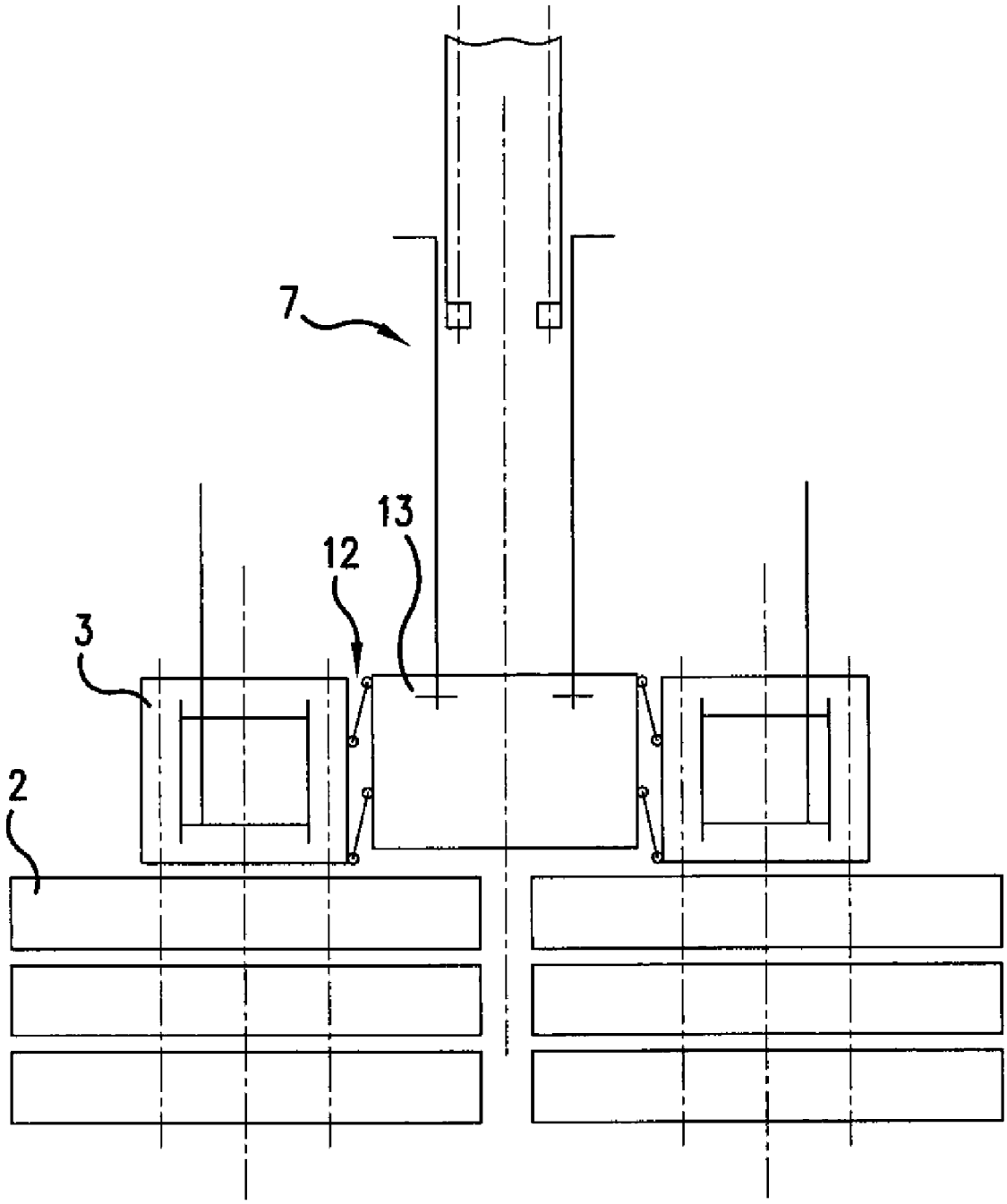
FIG. 3 a rear view of the crane superstructure, comprising tensioning means winches and counterweights.

FIG. 3 shows a rear view of the crane superstructure, wherein the counterweights 2, the cable winches 3 and a portion 13 of the crane superstructure can be seen more clearly. The laterally attached, lockable winches 3 are connected such that they can shift on the turntable, as indicated by the reference numeral 12, and they pull the cable of the winch 3 taut. The biasing and bracing forces are applied by fastening at least a portion of a counterweight arrangement 2 to the movable winch 3, as indicated by the dot-dash lines. The counterweights 2 thus obtain a new, additional function, namely as cable tensioners, which they can additionally perform without any further costs. A further advantage is that the counterweight arrangements 2 can be reduced by the amount of the weight of the winches 3, both elements applying a defined bias at the same time. A costly measuring means for the tensile cable is thus omitted.

Figure 4:
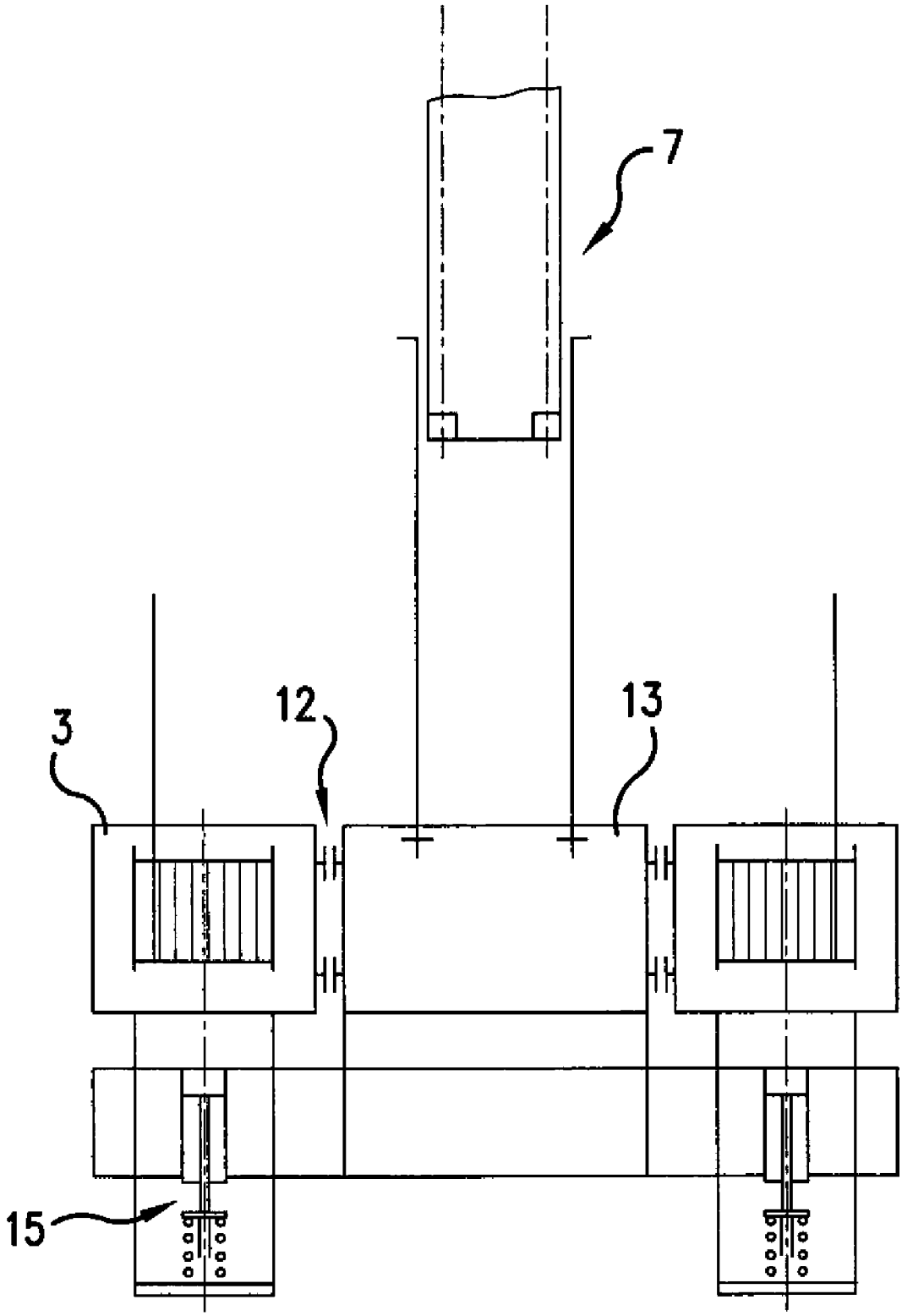
FIG. 4 a rear view of the crane superstructure, comprising tensioning means tensile units fastened damped.

In cranes with a limited counterweight, biasing can also be achieved via a tensile unit (for example, a cylinder, screw, wind, spring, etc.). FIG. 4 shows a system which is biased via a damped telescoping cylinder 15. The winch 3 is in turn fastened to the crane structure 13 by the sliding or shifting fastening 12 and can move up and down. On the lower portion of the structure, it is biased via the damped telescoping cylinder 15. Wind, expelling or inserting the jib portions or particular motor speeds can in principle cause the superstructure to swivel. The damped telescoping cylinder 15, which as shown is integrated into the bracing, can remove a dynamic problem.

It may be generally stated that maximum admissible stresses in the peripheral fibres, both in the jib (telescopic mast) and in the turntable support for the counterweight, caused by bending, are compensated for by the biasing and bracing in accordance with the invention. The material and deformations can be further optimised, if the appropriate bias can also be created in the lower cross-sectional part of the jib. This is achieved, for example, in an embodiment in accordance with FIGS. 5A and 5B, in which the telescopic mast 7 is biased and braced both above and below the center line. The bracing on the upper run in the embodiment in accordance with FIGS. 5A and 5B corresponds to that of FIGS. 1A and 1B. Additionally in this case, however, bracing and biasing is also realised in the lower cross-sectional part of the jib via the winch 17 fastened to the front of the crane superstructure, from which a tensile cable 11 runs, from which the portion 11*b* firstly runs to the upper roller 14 where it is turned and deflected and runs as the portion 11*a* to the fastening 16 on the first extending telescopic portion 5. The material and deformations can be optimised even further, since the pressure stress in the lower run 7*b* can be converted into a tensile stress using this measure. The tensioned cable sections 11*a* and 11*b* on the lower run impose a compression bias. If the telescopic mast 7 is loaded by lifting a load, the pressure stress in the jib is not increased. Rather, the tensile stress in the cables 11*a*, 11*b* is dissipated as it is replaced by the load acting on the lifting cable. In this was a lifted load remains substantially at the same point and deformation of the mast usually resulting from the lifting operation is minimised. Fatigue strength problems are reduced even further due to lower deformation and lower stress differences. The deformation of such a biased system is also then even significantly lower with respect to a non-biased system, if the tensile stress in the cables is fully dissipated and the latter have become slack. Using an upper and lower bias and bracing, damaging stress peaks are avoided, material is saved on, deformation is minimised and the bearing loads both in the range of strength and in the range of steadiness are increased. The torsion moment and the lateral moment in the jib are reduced, the cross-section becomes slimmer, the shell radii are narrower and the stability of the shells is increased.

Figure 5A:
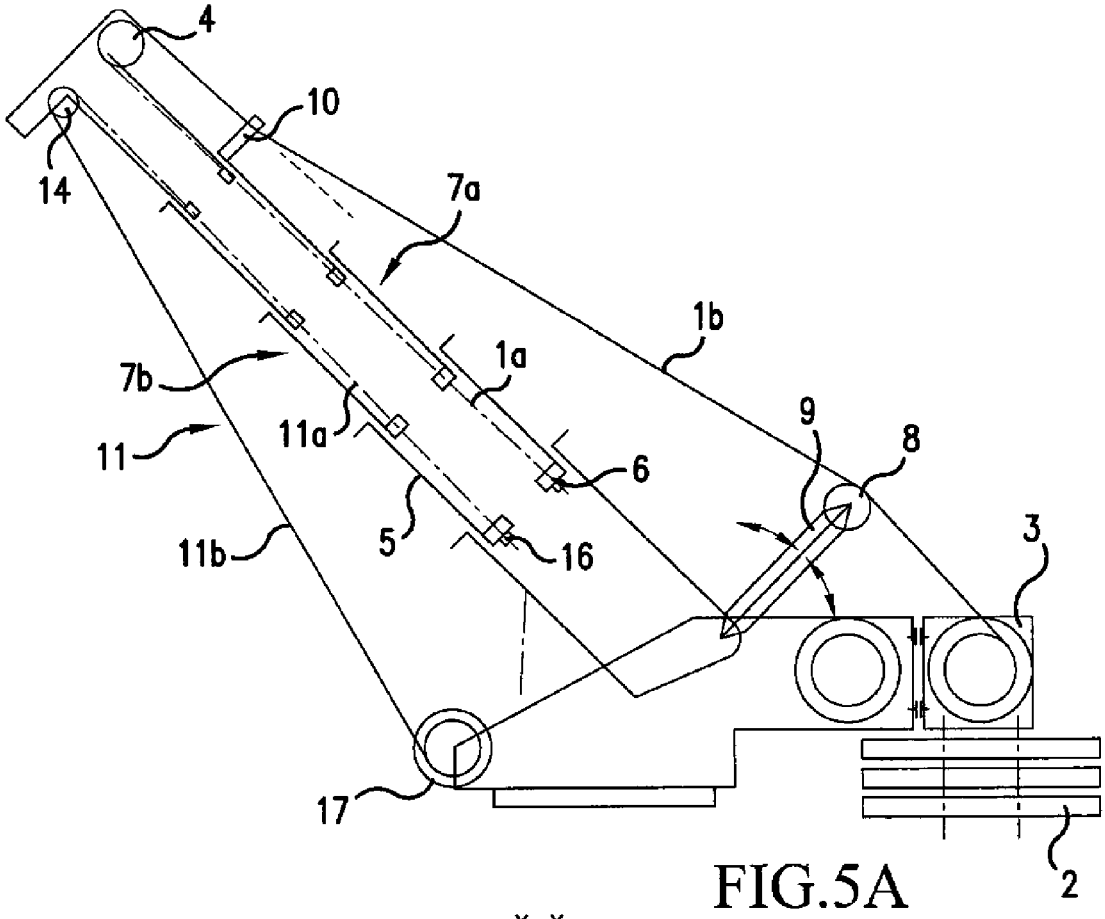
FIGS. 5A and 5B a lateral and a rear view of a telescopic mast, biased on the upper run and on the lower run in accordance with the invention.
Figure 5B:
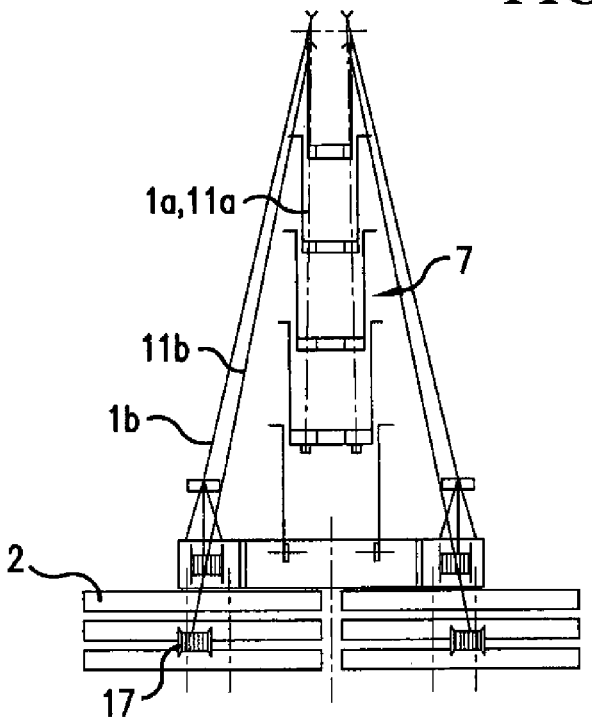
Figure 6A:
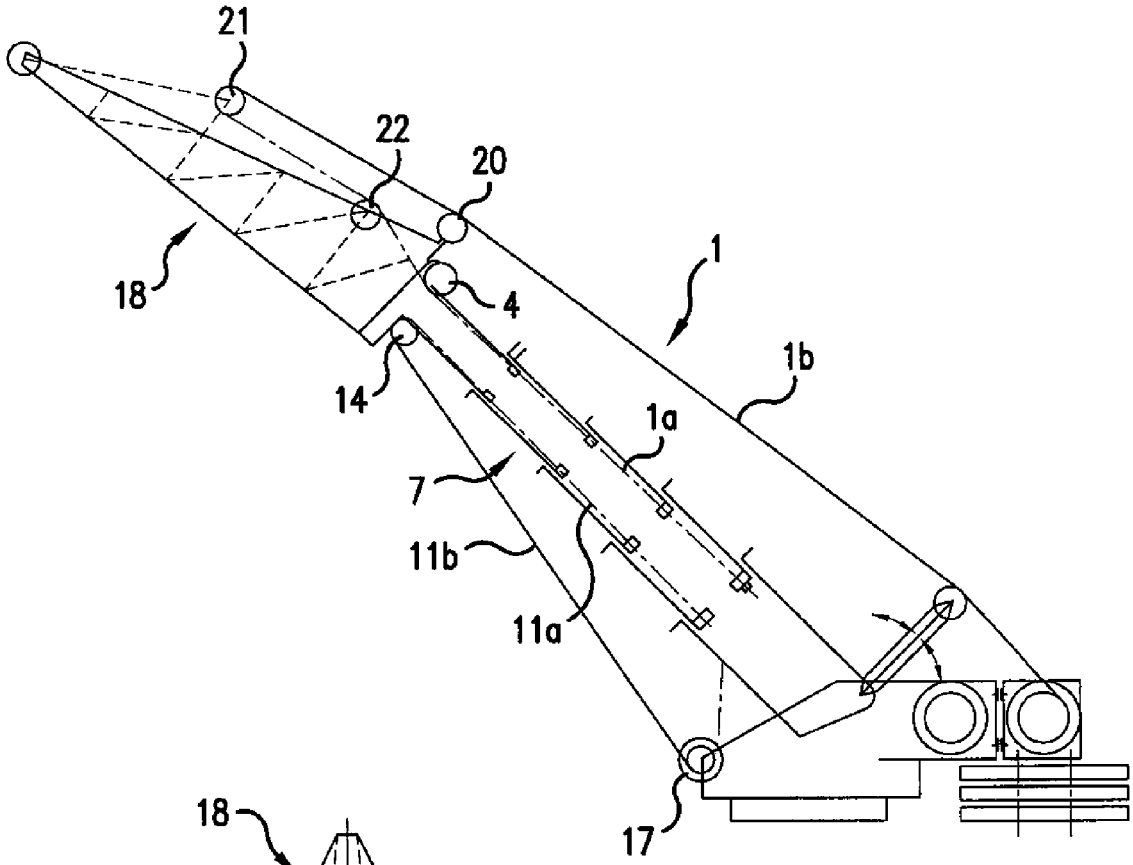
FIGS. 6A and 6B a lateral and a rear view of a telescopic mast, comprising a fixed auxiliary tip and provided with a tensioning system in accordance with the invention.
Figure 6B:
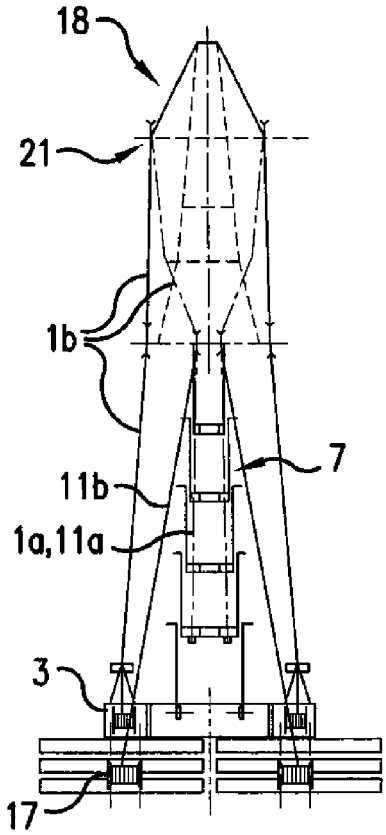
Figure 7A:
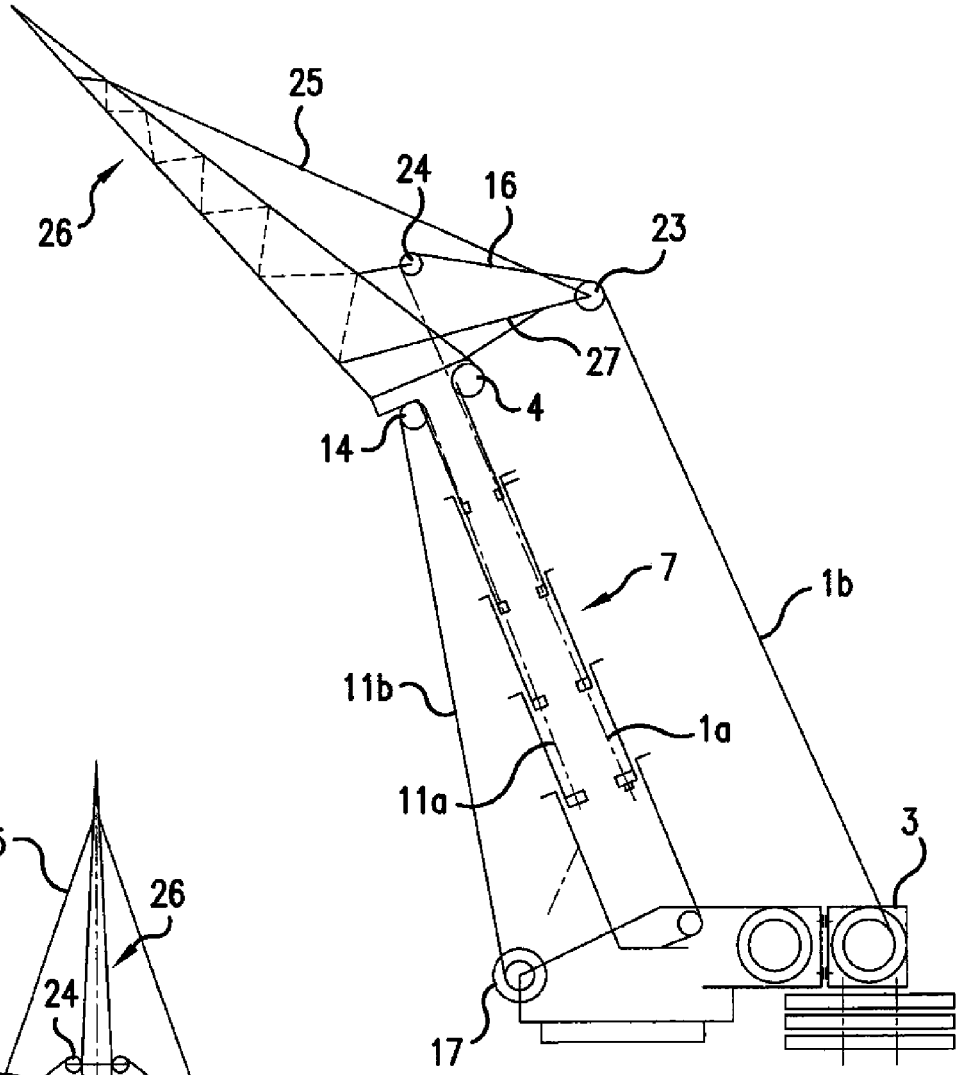
FIGS. 7A and 7B a lateral and a rear view of a telescopic mast, comprising a level luffing tip and provided with a tensioning system in accordance with the invention.
Figure 7B:
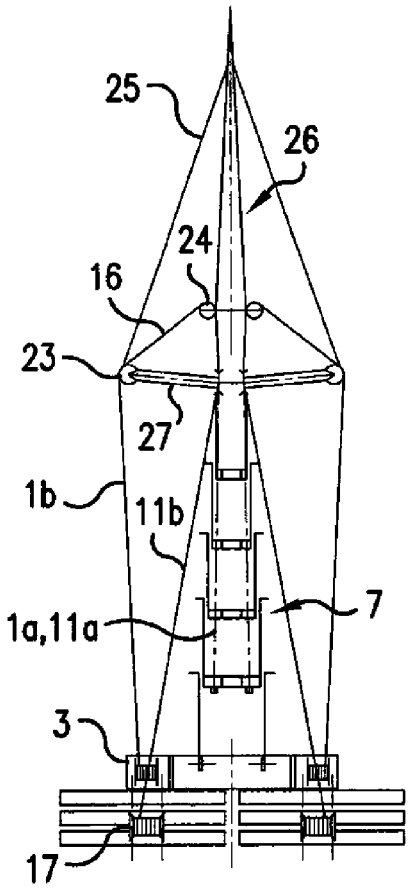

FIGS. 6A, 6B, 7A and 7B show embodiments operating with tips, namely a fixed tip (FIGS. 6A and 6B) and a level luffing tip (FIGS. 7A and 7B). In all these embodiments, the biasing and bracing design for the lower run is the same as in FIGS. 5A and 5B. For operating with a fixed tip, the guide for the cable 1 of the upper biasing and bracing is altered, as shown in FIGS. 6A and 6B. The cable section 1*b*, coming from the winch and pylon, runs firstly over the roller 20 and is guided on towards the tip head. The cable 1 is then guided via a turning and deflecting roller 21, laterally situated on the tip, and via a further roller 22, and as the portion 1*a* back into the telescopic mast, so as to be able to fulfil the biasing function. The design via the turning and deflecting rollers 21 on the head and the tip adaptors is open at the top. It is therefore not necessary to release the cable ends, since the cables can be suspended from the turning deflection on the jib head into the turning and deflecting devices on the tip. The cables are then tensioned and biased again by the winches 3. Depending on the length of the overall system, the cables above have to run over one or more laterally attached cable grabs (rollers 22 and 4). The fixed tip 18 is thus integrated as a whole into the biasing and bracing.

The level luffing tip 26 shown in FIGS. 7A and 7B is likewise incorporated into the tensioning system in accordance with the invention. The cable 1*b* runs over the bracing gantries 27, which run laterally and obliquely, where it is turned and deflected on the roller 23, in order to then in turn run to the roller 24 which is laterally fastened above on the level luffing tip 26. From there, the cable 1*a* runs to the fastening point in the telescopic mast 7. The level luffing tip is inclined via the tensioning means 25. In this way, the tensioning system in accordance with the invention can also be integrated when operating with a level luffing tip.

Figure 8A:
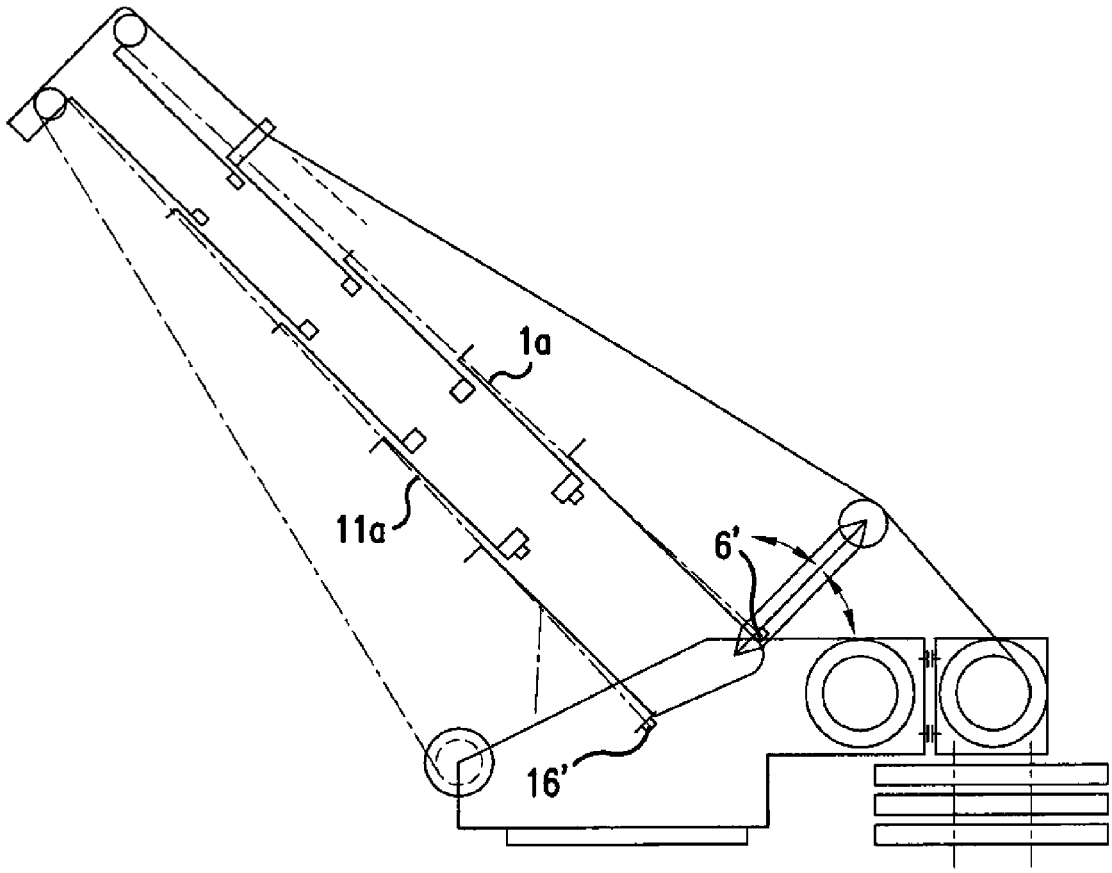
FIGS. 8A and 8B a lateral and a rear view of a telescopic mast, biased on the upper run and on the lower run in accordance with the invention and comprising tensioning means running outwardly.
Figure 8B:
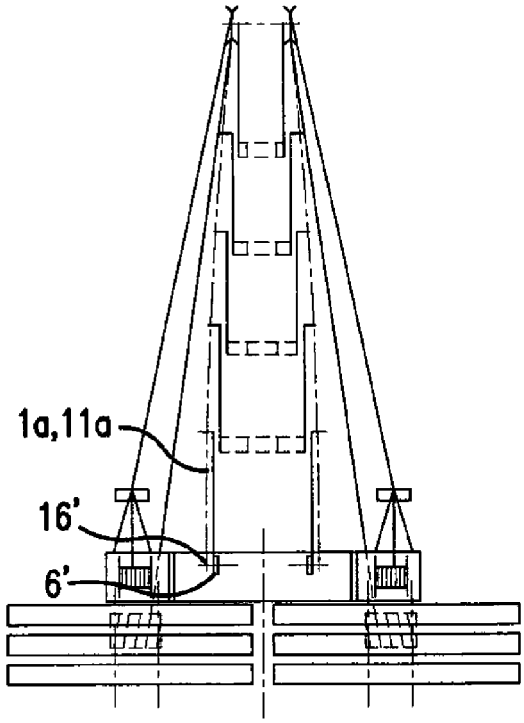

FIGS. 8A and 8B show yet another embodiment of a crane in accordance with the invention. The crane in accordance with FIGS. 8A and 8B is designed exactly like the crane from FIGS. 5A and 5B, except for the return of the cable sections 1*a* and 11*a* and the lower fastening. For this reason, only the differently arranged elements 1*a*, 11*a*, 6' and 16' are indicated.

In the crane in accordance with FIGS. 8A and 8B, the cable sections 1*a* and 11*a* are not guided back down within the mast, and they are also fastened at their lowermost point differently than in the embodiment in accordance with FIGS. 5A and 5B. For in accordance with FIGS. 8A and 8B, the cable sections 1*a* and 11*a* are guided back outside the jib and along the jib to the lower fastening points 6' for the cable section 1*a* and 16' for the cable section 11*a*. The lower fastening point 6' is situated on the superstructure, as is the lower fastening point 16' for the cable section 11*a*. In this arrangement, too, the cable sections 1*a* and 11*a* can, together with the remaining tensioning system, ensure a pressure bias of the jib.

The invention claimed is:

1. A tensioning system for a mobile telescopic crane having a superstructure supporting a telescopic mast, comprising:

at least one tensioning cable for bracing the telescopic mast; and at least one tensioning winch mounted on the crane superstructure for tensioning said cable to thereby create a pressure bias within said mast;

wherein said winch is movable with respect to said superstructure of the crane and movement of the winch relative to the superstructure imposes tension on said cable.

2. The tensioning system as set forth in claim 1, wherein the tensioning winch is connected to counterweights of the crane.

3. The tensioning system as set forth in claim 1, wherein said tensioning winch is arranged behind the point where the mast joins the crane superstructure.

4. The tensioning system as set forth in claim 3, wherein the tensioning winch is connected to counterweights of the crane.

5. A tensioning system as in claim 1, wherein said tensioning winch comprises a weight for tensioning said cable.

6. A tensioning system as in claim 5, wherein said tensioning winch is positioned with respect to the telescopic mast to serve also as a counterweight for said telescopic crane.

7. A tensioning system as in claim 5, wherein said tensioning winch takes up and pays out said tensioning cable.

8. A tensioning system as in claim 6, wherein said winch is movable vertically with respect to the crane superstructure.

9. A tensioning system as in claim 1, wherein said winch is movable vertically with respect to the crane superstructure.

10. A tensioning system as in claim 1, comprising at least two tensioning cables, at least one tensioning cable being positioned to each side of the telescopic mast.

11. The tensioning system as in claim 10, comprising a tensioning winch for each said tensioning cable, said tensioning winches being arranged on the crane superstructure on opposite sides of the luffing plane of the telescopic mast of the crane and at a distance from the luffing plane whereby the tensioning cables can absorb a substantial proportion of loads having components perpendicular to the luffing plane.

12. A tensioning system as in claim 11, wherein each said tensioning winch takes up or pays out a respective tensioning cable.

13. A tensioning system as in claim 11, wherein said winches are each movable with respect to the crane superstructure.

14. The tensioning system as set forth in claim 1, wherein said at least one tensioning cable extends along and creates a pressure bias in an upper cross sectional portion of the mast, further comprising at least a second tensioning cable extending along and creating a pressure bias in a lower cross sectional portion of the mast.

15. The tensioning system as set forth in claim 14, comprising at least two of said second tensioning cables extending along the lower cross sectional portion of the mast, at least one such second tensioning cable extending on each side of the mast.

16. The tensioning system as set forth in claim 1, wherein each tensioning winch is attached to the crane superstructure via one or more damping units.

* * * * *